US005169739A

United States Patent [19]

Umemura et al.

[11] Patent Number: 5,169,739

[45] Date of Patent: Dec. 8, 1992

[54] LIQUID DEVELOPER FOR IMAGE FIXING METHOD USING HEAT APPLICATION ROLLERS

[75] Inventors: Kazuhiko Umemura, Susono; Kazuo Tsubuko, Numazu; Shinichi Kuramoto, Numazu; Toshihiko Takahashi, Numazu; Hidemi Uematsu, Fuji, all of Japan

[73] Assignee: Ricoh Company, Ltd., Tokyo, Japan

[21] Appl. No.: 479,527

[22] Filed: Feb. 13, 1990

[30] Foreign Application Priority Data

Feb. 20, 1989 [JP] Japan ..... 1-038460

[51] Int. Cl.[5] ..... G03G 9/00

[52] U.S. Cl. ..... 430/114; 430/115; 430/904

[58] Field of Search ..... 430/114, 115, 904

[56] References Cited

U.S. PATENT DOCUMENTS

| | | | |
|---|---|---|---|
| 4,259,428 | 3/1981 | Tsuneda | 430/115 |
| 4,860,050 | 8/1989 | Kurotori et al. | 430/115 X |
| 4,957,842 | 9/1990 | Fukase et al. | 430/114 |
| 5,055,370 | 10/1991 | Suzuki et al. | 430/114 |

*Primary Examiner*—Marion E. McCamish
*Assistant Examiner*—Stephen Crosson
*Attorney, Agent, or Firm*—Cooper & Dunham

[57] ABSTRACT

A liquid developer comprises an aliphatic hydrocarbon carrier liquid and a toner dispersed in the carrier liquid, which toner comprises a coloring agent and a resin component, wherein a solid toner component which is obtained by evaporating the liquid developer to dryness has a softening point of 60° C. to 90° C. and flow-initiating point of 110° C. to 160° C.

6 Claims, 1 Drawing Sheet

FIGURE
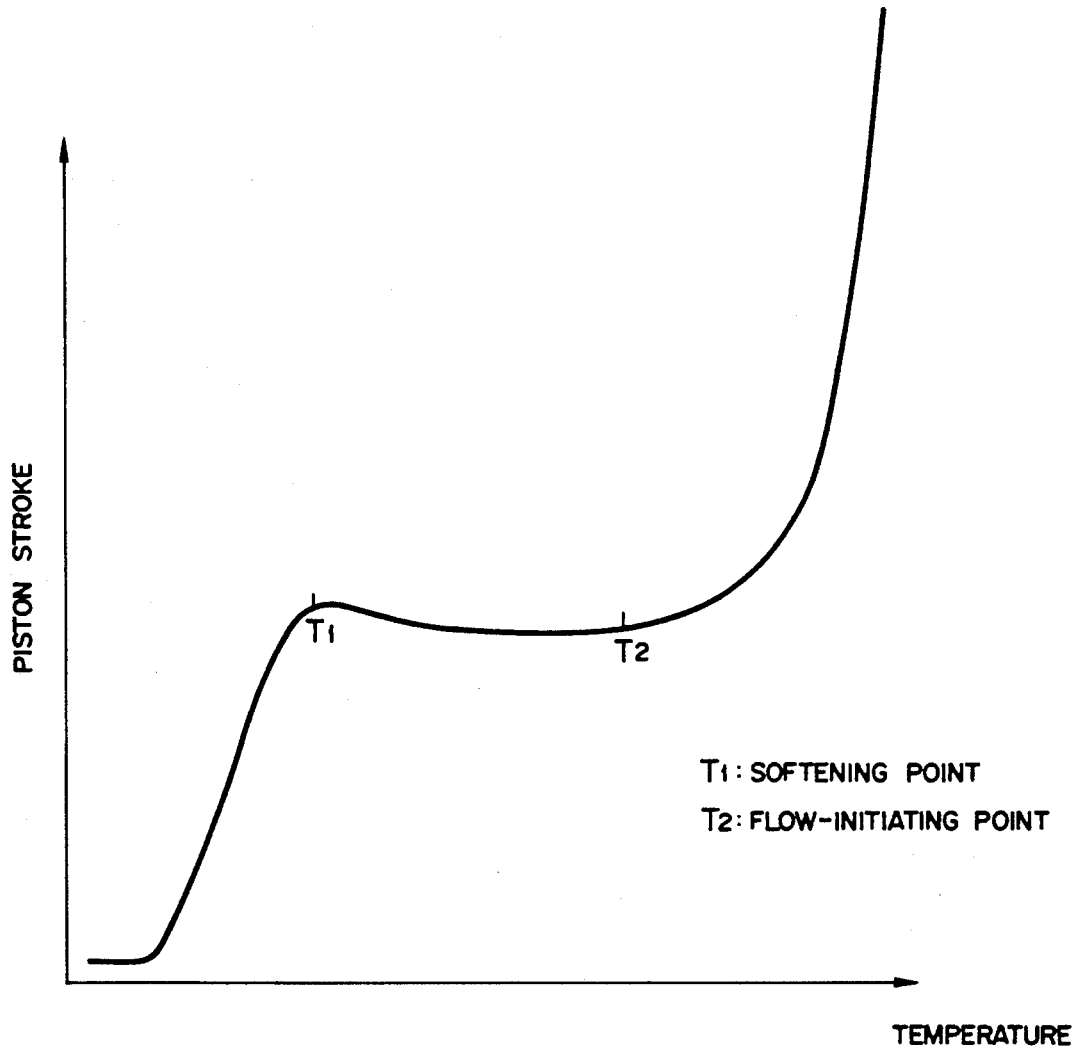

LIQUID DEVELOPER FOR IMAGE FIXING METHOD USING HEAT APPLICATION ROLLERS

FIELD OF THE INVENTION

The present invention relates to a liquid developer which is applicable to a copy operation, in particular, to a copy operation in which image fixing is achieved by means of a heat-application roller.

DISCUSSION OF BACKGROUND

In the conventional copying process using a liquid-type developer, a toner-image-bearing copying sheet or paper is heated from the back side thereof by means of a heat-application roller which is maintained at a high temperature to evaporate a carrier liquid component from the toner images formed on the copying paper, in order to fix toner images on the copying paper. However, the above-mentioned toner image fixing method requires a large amount of thermal energy for fixing toner images on the copying paper. Furthermore, in the case of a duplex copying process, when the aforementioned large amount of thermal energy is applied to a copying sheet for second image fixing on a second side the copying sheet, toner images which have been already fixed on a first side thereof are also heated, so that there is the risk that the already fixed toner images are melted again. The melted toner stains heat-application members, or the images formed on the first side of the copying sheet tend to become blurred.

Therefore, various studies have been made, with a special emphasis laid on the image fixing method in which the surface of a toner-image-bearing sheet is brought into direct contact with the heat-application roller, from the viewpoints of saving energy, increasing copying speed and obtaining high quality images.

However, in the case of commercially available liquid-type developers, both the softening point and the flow-initiating point of the toner components thereof, measured by a capillary rheometer, are generally low and close to each other. The reason for this is that the above commercially available liquid-type developers are designed as to smoothly spread on the copying paper and easily permeate thereinto when fused for image fixing. To surely fix images on the copying paper using the aforementioned commercially available liquid-type developers, the temperature of the employed heat-application roller must be accurately set within a considerably narrow range. When the temperature of the heat-application roller is lower than the above range, image fixing will become imperfect. On the other hand, when it is higher than the above range, a so-called "off-set phenomenon" will occur. Specifically, when the heat-application roller which is heated to a temperature higher than the above-mentioned range is brought into pressure contact with a toner-image-bearing copying sheet, part of the hot, melted toner on the copying sheet is transferred to the surface of the heat-application roller, and the thus transferred toner is disadvantageously re-transferred to the copying paper and stains the same to form the so-called ghost images on the copying sheet.

SUMMARY OF THE INVENTION

Accordingly, an object of the present invention is to provide a liquid developer capable of satisfactorily performing image fixing on a copying paper, without causing the so-called off-set phenomenon, in a wet-type copying apparatus in which toner images are fixed to the copying sheet by means of a heat-application roller.

The above-mentioned object of the present invention can be achieved by a liquid developer for the image fixing method using a heat-application roller, comprising an aliphatic hydrocarbon carrier liquid and a toner dispersed therein, which comprises a coloring agent and a resin component, with a solid toner component obtained by evaporating the liquid developer to dryness having a softening point of 60° C. to 90° C. and a flow-initiating point of 110° C. to 160° C.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein:

A single FIGURE is a graph in explanation of the softening point and the flow-initiating point of the liquid-type developer according to the present invention.

DETAILED DESCRIPTION OF THE PREFERRED EMBODIMENTS

In the liquid developer for the image fixing method using a heat-application roller according to the present invention, which comprises (1) a toner and (2) a carrier liquid, a solid toner component obtained by evaporating the liquid developer to dryness has a softening point of 60° C. to 90° C. and a flow-initiating point of 110° C. to 160° C.

In the present invention, the above softening point and flow-initiating point are measured by a commercially available flow tester "Shimadzu CFT-500C FLOWTESTER Capillary Rheometer" made by Shimadzu Corporation.

The aforementioned softening point and flow-initiating point of the solid toner component of the liquid developer will now be explained in detail by referring to a single FIGURE.

In the present invention, when the softening point and flow-initiating point of the solid toner component are measured, a sample of the solid toner component is placed in a cylinder of the above-mentioned flowtester, and the temperature of a heater built in the cylinder is increased at a prescribed rate. By means of a piston, a predetermined pressure is applied to the sample from above as it is heated. When the sample is completely melted, it is extruded through a small orifice in a die. On this principle, the softening point and the flow-initiating point can be obtained from the piston stroke of the flow tester.

More specifically, as shown in the single FIGURE, the softening point ($T_1$) of a solid toner component is obtained when the piston of the above-mentioned commercially available flow tester attains to a first peak as the temperature of the toner component is increased at a prescribed rate. When the temperature of the sample of the toner component is elevated beyond its softening point ($T_1$), the stroke of the piston slightly decreases and then drastically increases. The flow-initiating point ($T_2$) of the toner component is at the minimum point before the drastic increase of the piston stroke.

The components of the liquid developer according to the present invention will now be explained in detail.

Examples of the carrier liquid used in the liquid developer according to the present invention are cyclohexane, n-hexane, n-heptane, n-nonane, n-octane, isooctane, isododecane, ligroin and mixtures thereof.

Examples the mixtures of the above aliphatic hydrocarbon solvents are "Isopar E", "Isopar G", "Isopar H", "Isopar L", "Isopar K", "Solvesso 100" and "Solvesso 150" which are commercially available from Exxon Chemical Japan Ltd.; and "Shellsol 71", commercially available from Yuka Shell Epoxy K.K.

Examples of the coloring agent of the liquid developer according to the present invention are (i) inorganic pigments, such as zinc oxide and titanium oxide, and commercially available carbon black pigments such as "Printex V", "Printex U", "Printex G", "Special Black 15", "Special Black 4" and "Special Black 4-B" (made by Degussa Japan Co., Ltd.); "Mitsubishi #44", "Mitsubishi #30", "MA-11" and "MA-100" (made by Mitsubishi Carbon Co.); "Raben 1035", "Raben 1252" and "New Spectra II" (made by Columbia Carbon Ltd.); and "Regal 400", "Regal 600", "Black Pearl 900", "Black Pearl 1100" and "Black Pearl 1300" (made by Cabot Co., Ltd.); and (ii) organic pigments used as the coloring agent include Phthalocyanine Blue, Phthalocyanine Green, Sky Blue, Rhodamine Lake, Malachite Green Lake, Methyl Violet Lake, Peacock Blue Lake, Naphthol Green B, Naphthol Green Y, Naphthol Yellow S, Naphthol Red, Lithol Fast Yellow 2G, Permanent Red 4R, Brilliant Fast Scarlet, Hansa Yellow, Benzidine Yellow, Lithol Red, Lake Red C, Lake Red D, Brilliant Carmine 6B, Permanent Red F5R, Pigment Scarlet 3B, Indigo, Thioindigo, Oil Pink and Bordeaux 10B.

It is preferable that the above-mentioned coloring agents be treated with modified polyolefins. Examples of the modified polyolefins for use in the present invention are polyethylene oxide, polypropylene oxide, ethylene -(meth)acrylic acid copolymer (molar ratio of 70:30), ethylene - (meth)acrylic acid ester (molar ratio of 85:15), propylene - (meth)acrylic acid copolymer (molar ratio of 80:20), propylene - (meth)acrylic acid ester copolymer (molar ratio of 80:20) and ethylene - ethylacrylate -acrylic acid terpolymer (molar ratio of 80:10:10). It is preferable that those modified polyolefins be kneaded together with the above-mentioned inorganic or organic pigments under application of heat and the thus obtained mixture be uniformly dispersed by means of flushing.

Examples of the resin component of the toner for use in the present invention are synthetic polyethylene, polypropylene and modified polypropylene. As the above synthetic polyethylene polypropylene and modified polypropylene, the following commercially available products can be employed: 110P, 220P, 220MK, 820MK, 410MP, 210MP, 310MP, 405MP, 200P, 4202E and 4053E (commercially available from Mitsui Petrochemical Industries, Ltd.); 131P, 151P, 161P, 171P, E300 and E250P (commercially available from Sanyo Chemical Industries, Ltd.); N-0, N-11, N-12, N-14, N-34, N-45, C-10, C-13, C-15, C-16, E-10, E-11, E-12, E-14 and E-15 commercially available from Eastman Chemical Products, Inc.); H1, H2, A1, A2, A3 and A4 (commercially available from Sazol Co., Ltd.); OA wax and A wax (commercially available from BASF Japan Ltd.); Bareco 500, Bareco 200, E-730, E-2018, E-2020, E-1040, Petronaba C, Petronaba C-36, Petronaba C-400 and Petronaba C-7500 (commercially available from Petrolite Co., Ltd.); PE 580, PE 130, PED 121, PED 136, PED 153, PED 521, PED 522 and ED 534 (commercially available from Hoechst Japan Ltd.); DYNI, DYNF, DYNH, DYNJ and DYNK (commercially available from Union Carbide Japan K.K.); Oruzon 805, Oruzon 705 and Oruzon 50 [commercially available from Monsanto Co.); Alathon 3, Alathon 10, Alathon 12, Alathon 14, Alathon 16, Alathon 20, Alathon 22 and Alathon 23 (commercially available from Du pont de Nemours, E.I. & Co.); and AC Polyethylene 6, AC Polyethylene 6A and AC Polyethylene 615 [commercially available from Allied Chemical Corp.).

In addition to the above, natural waxes such as carnauba wax, montan wax, candelilla wax, sugar cane wax, beewax, Japan wax and rice bran wax, natural resins such as ester gum and hardened rosin, natural-resin modified cured resins such as natural-resin-modified maleic acid resin, natural-resin-modified phenolic resin, natural-resin-modified polyester resin, natural-resin-modified pentaerythritol resin and epoxy resin can be used as the resin component in the present invention.

As other resin components of the toner used in the liquid developer according to the present invention, copolymers and graft polymers of vinyl monomer A represented by the following formula (I) and at least one monomer selected from the group consisting of a vinyl monomer B represented by formula (II), vinylpyridine, ethylene glycol dimethacrylate, styrene, divinylbenzene and vinyltoluene are preferably used:

Vinyl Monomer A

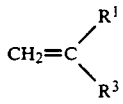

(I)

wherein $R^1$ is H or $CH_3$; and $R^3$ is $COOC_nH_{2n+1}$, in which n is an integer of 6 to 20.

Vinyl Monomer B

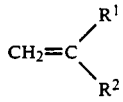

(II)

wherein $R^1$ is H or $CH_3$; and $R^2$ is $COOC_nH_{2n+1}$, in which n is an integer of 1 to 5, $COOCH_2.CH{=}CH_2$,

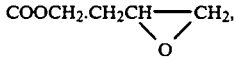

$COOCH_2.C(CH_3){=}CH_2$, COOH, $COOCH_2.CH_2OH$, $COOCH_2.CH_2N(CH_3)_2$, or $COOCH_2.CH_2N(C_2H_5)_2$.

In the present invention, surface active agents can also be used when necessary.

In order to set or adjust the softening point and the flow-initiating point of the solid toner component of the liquid developer according to the present invention, the following methods can be employed: adjusting the polymerization degree of the employed resins; using several resins in combination, and partial cross-linking of the employed resin. It is recommended to select the best method from the above in accordance with the productivity of the developer, since each method yields a little difference in the physical characteristics of the liquid developer.

Other features of this invention will become apparent in the course of the following description of exemplary embodiments, which are given for illustration of the invention and are not intended to be limiting thereof.

EXAMPLE 1

The following components were placed in a ball mill and dispersed for 40 hours, whereby liquid developer No. 1 according to the present invention was prepared:

| | |
|---|---|
| Lauryl methacrylate/glycidyl methacrylate/methyl methacrylate terpolymer (80:10:10 in molar ratio) | 500 g |
| Carbon black (Trademark "Special Black 4-B" made by Degussa Japan Co., Ltd.) | 500 g |
| Isopar H (made by Exxon Chemical Co., Ltd.) | 700 g |

EXAMPLE 2

The following components were blended:

| | |
|---|---|
| Glycidyl methacrylate/ methyl methacrylate copolymer (1:1 in molar ratio) | 200 g |
| Polyethylene | 400 g |
| Carnauba wax | 400 g |

300 g of the above prepared mixture and 200 g of Phthalocyanine Blue were added to 500 g of Isopar L (made by Exxon Chemical Co., Ltd.) and dispersed in a ball mill for 30 hours, whereby liquid developer No. 2 according to the present invention was prepared.

The softening point and the flow-initiating point of the liquid developer No. 1 were 80° C. and 140° C., respectively.

The softening point and the flow-initiating point of the liquid developer No. 2 were 82° C. and 150° C., respectively.

Using each of the above prepared liquid developers No. 1 and No. 2 according to the present invention, toner images were developed and transferred to a sheet of copying paper. The thus transferred toner images were fixed by use of a heat-application roller made of polytetrafluoroethylene (PTFE). As a result, toner images were satisfactorily fixed to the copying paper, without the occurrence of the off-set phenomenon when the temperature of the surface of the heat-application roller was set in the range of 100° C. to 180° C.

As described above, when the liquid developer according to the present invention is employed in a copying machine which is equipped with a heat-application roller for image fixing, toner images can be satisfactorily fixed to a sheet of copying paper without causing the off-set phenomenon, with the temperature of a heat-application roller being set within a relatively wide range.

What is claimed is:

1. A liquid developer for use in an image fixing method in which the surface of a toner-image-bearing sheet is brought into direct contact with a heat-application roller, comprising an aliphatic hydrocarbon carrier liquid and a toner dispersed in said carrier liquid, said toner comprising a coloring agent a resin component, wherein a solid toner component which is obtained by evaporating said liquid developer to dryness has a softening point of 60° C. to 90° C and a flow-initiating point of 110° C. to 160° C.

2. The liquid developer as claimed in claim 1, wherein said aliphatic hydrocarbon carrier liquid is selected from the group consisting of cyclohexanone, n-hexane, n-heptane, n-nonane, n-octane, isooctane, isodecane, ligroin and a mixture thereof.

3. The liquid developer as claimed in claim 1, wherein said coloring agent is treated by a modified polyolefin.

4. The liquid developer as claimed in claim 3, wherein said modified polyolefin is selected from the group consisting of polyethylene oxide, polypropylene oxide, ethylene - methacrylic acid copolymer (molar ratio of 70:30), ethylene - methacrylic acid ester (molar ratio of 85:15), propylene - methacrylic acid copolymer (molar ratio of 80:20), propylene - methacrylic acid ester copolymer (molar ratio of 80:20), ethylene - acrylic acid copolymer (molar ratio of 70:30), ethylene - acrylic acid ester (molar ratio of 85:15), propylene - acrylic acid copolymer (molar ratio of 80:20), propylene - acrylic acid ester copolymer (molar ratio of 80:20) and ethylene - ethylacrylate -acrylic acid terpolymer (molar ratio of 80:10:10).

5. The liquid developer as claimed in claim 1, wherein said resin component of said toner is selected from the group consisting of propylene and modified propylene.

6. The liquid developer as claimed in claim 1, wherein said resin component of said toner is selected from the group consisting of copolymers and graft polymers of vinyl monomer A represented by formula (I),

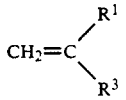

(I)

wherein $R^1$ is H or $CH_3$; and $R^3$ is $COOC_nH_{2n+1}$, in which n is an integer of 6 to 20, and at least one monomer selected from the group consisting of a vinyl monomer B represented by formula (II),

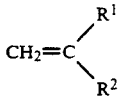

(II)

wherein $R^1$ is H or $CH_3$; and $R^2$ is $COOC_nH_{2n+1}$, in which n is an integer of 1 to 5, $COOCH_2.CH{=}CH_2$,

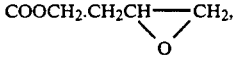

$COOCH_2.C(CH_3){=}CH_2$, COOH, $COOCH_2.CH_2OH$, $COOCH_2.CH_2N(CH_3)_2$, or $COOCH_2.CH_2N(C_2H_5)_2$, vinylpyridine, ethylene glycol dimethacrylate, styrene, divinylbenzene and vinyltoluene.

* * * * *